US006904709B2

(12) United States Patent
Craig et al.

(10) Patent No.: US 6,904,709 B2
(45) Date of Patent: Jun. 14, 2005

(54) DISPLAY PANEL FOR A VEHICLE

(75) Inventors: Lawrence Craig, Glasgow (GB); Joseph Blake, Glasgow (GB)

(73) Assignee: Spedian Limited, Glasgow (GB)

( * ) Notice: Subject to any disclaimer, the term of this patent is extended or adjusted under 35 U.S.C. 154(b) by 0 days.

(21) Appl. No.: 10/434,567

(22) Filed: May 9, 2003

(65) Prior Publication Data

US 2004/0035033 A1 Feb. 26, 2004

(30) Foreign Application Priority Data

May 10, 2002 (GB) ..... 0210681
Sep. 19, 2002 (GB) ..... 0221722

(51) Int. Cl.[7] ..... G09F 21/04
(52) U.S. Cl. ..... 40/590; 40/591; 40/594; 428/100
(58) Field of Search ..... 40/588, 590, 591, 40/594, 606.1, 607.13, 607.15; 428/100

(56) References Cited

U.S. PATENT DOCUMENTS

| | | | | | |
|---|---|---|---|---|---|
| 3,372,503 | A | * | 3/1968 | Weeks | 40/600 |
| 5,415,451 | A | * | 5/1995 | Stanton | 40/590 |
| 5,611,122 | A | * | 3/1997 | Torigoe et al. | 428/100 |
| 5,671,511 | A | * | 9/1997 | Hattori et al. | 428/100 |
| 6,276,082 | B1 | * | 8/2001 | Richards et al. | 40/590 |
| 2002/0029504 | A1 | * | 3/2002 | Lowndes | 40/590 |
| 2003/0140539 | A1 | * | 7/2003 | Green et al. | 40/590 |

* cited by examiner

*Primary Examiner*—Gary C. Hoge
(74) *Attorney, Agent, or Firm*—Kirkpatrick & Lockhart Nicholson Graham LLP

(57) ABSTRACT

A display panel, for example an advertising panel, for use on an external surface of a vehicle is described. The display panel comprises a substantially non-permeable flexible sheet and is removably fastened to the vehicle around the around the majority of the perimeter of the flexible sheet. An adapted vehicle, a vehicle and panel assembly, and a method of application are also described. In one embodiment, the fastening material is provided with strategically placed gaps to act as fluid outlets.

6 Claims, 6 Drawing Sheets

DISPLAY PANEL FOR A VEHICLE

CROSS-REFERENCE TO RELATED APPLICATIONS

This application claims priority to United Kingdom Provisional Patent Applications, GB 0210681.3, filed May 10, 2002, and GB 0221722.2, filed Sep. 19, 2002, the disclosures of which are herein incorporated by reference in their entireties.

FIELD OF THE INVENTION

This invention relates to display panels mounted on vehicles, in particular advertising panels using non-obtrusive and substantially airtight reclosable fasteners.

BACKGROUND OF THE INVENTION

In the field of advertising, the sides of trucks may be used to display advertising signs. Such mobile advertisements benefit advertisers with a useful advertising medium, and further benefit truck operators with an additional revenue source.

Advertising signs typically comprise printed PVC (poly vinyl chloride) sheets that are impervious to air and water. The sign may optionally further comprise reinforcements and fasteners.

Advertising signs on vehicles need to be prevented from catching air as the vehicle moves. The flow of air behind the sign can cause billowing, flapping and damage to or loosening of the sign.

One solution uses PVC sheets that are tensioned into a frame attached to the side of the truck. A PVC sheet, that has been digitally printed with an image, is unrolled and beading is fed into ridges around the edge of the sheet. The edge now containing the beading is fed into grooves along a frame attached to the side of the truck, and finally the sheet with beading is riveted securely into the frame.

U.S. Pat. No. 6,305,111 discloses an advertising display mounted on the side of a truck or any other substantially planar surface. The display includes an elastic display sign with four edges reinforced by stays. Attachment fittings are spaced along the edge of the supporting structure.

U.S. Pat. No. 6,167,649 discloses an information display system mounted on flat surfaces, such as the side of truck trailers, including a frame with a flexible sheet attached to the frame. There is an anchoring bracket rigidly attached to the side wall at each corner. Other anchoring brackets are attached at various locations along the sign's edges. The sign is a sheet of flexible plastic or cloth made from tightly woven natural or synthetic fibres.

The problems with these known approaches are the complicated and obtrusive nature of the fasteners attached (including by bolting) to the body of the vehicle. Furthermore, the advertising sheet itself requires complex adapting or attachment to a frame. All of these approaches use complex methods of engaging and tensioning the sheet.

Using a mesh sheet to allow more free airflow through the sign has the disadvantages of being difficult to print, having reduced quality of the printed image, being difficult to clean, having a tendency to stretch and the inability to add hidden fasteners around the centre of the image.

SUMMARY OF THE INVENTION

In this document, the statement of invention and claims, a panel refers to the combination of a sheet with the fasteners affixed to it that enable the combination to be removably attached to a vehicle.

It is an object of at least one aspect of the present invention to provide an advertising panel that can be attached to a vehicle without obtrusive fasteners, that can be easily removed and reapplied, and that does not require complicated fastener installation on the vehicle or in constructing the panel itself.

It is an object of at least one aspect of the present invention to provide an advertising panel that is easy to clean, is held strongly in place, is non-permeable and that is sealed around at least part of its peripheral edge to inhibit air ingress between the panel and the truck while the truck is in motion.

It is an object of at least one aspect of the present invention to provide a means of attaching advertising panels to the side of vehicles wherein the panels are substantially airtight and easy to mount and remove.

According to a first aspect of the present invention, there is provided a display panel for use on an external surface of a vehicle, the display panel comprising a substantially non-permeable flexible sheet and at least one first fastening element attached around the majority of the perimeter of said flexible sheet and adapted to reclosably interlock with at least one second fastening element attached to said external surface of a vehicle.

According to a second aspect of the present invention, there is provided a vehicle and panel assembly, wherein the panel comprises at least one first fastening element arranged around the majority of the perimeter of said panel, the vehicle comprises at least one second fastening element attached to an external surface of the vehicle, the second at least one fastening element being adapted to reclosably interlock with said at least one first fastening element.

According to the a third aspect of the invention, there is provided a vehicle adapted to receive a panel thereon, the vehicle comprising at least one fastening element attached to an external surface of the vehicle, the at least one fastening element being adapted to reclosably interlock with at least one corresponding fastening element arranged around the majority of the perimeter of said panel.

According to a fourth aspect of the invention, there is provided a method of mounting a display panel comprising a substantially non-permeable flexible sheet to a vehicle, the method comprising the steps of:

- attaching at least one first fastening element to said flexible sheet around the majority of the perimeter of said flexible sheet;
- attaching at least one second fastening element to an external surface of the vehicle, the external surface of the vehicle being oriented substantially in a surface plane; and
- imparting a force to said first and second fastening elements in a direction substantially perpendicular to the surface plane.

According to a fifth aspect of the invention, there is provided a method of removing a display panel comprising a substantially non-permeable flexible sheet from a vehicle, the method comprising the steps of:

- attaching at least one first fastening element to said flexible sheet;
- attaching at least one second fastening element to an external surface of said vehicle; and
- pulling said display panel perpendicular to the plane of the external surface of a vehicle.

Preferably said display panel is an advertising panel.

Typically said flexible sheet comprises a PVC coating.

Preferably said flexible sheet is printed on the side opposite to said at least one fastening element.

Preferably said fastening elements are adapted to reclosably interlock with another fastening element identical to said fastening element.

Alternatively, said first fastening element and said second fastening element are hook and loop fasteners.

Preferably said first fastening elements are arranged to match the position of corresponding second fastening elements on said external surface of a vehicle to form a corresponding pair of fastening elements.

Preferably said fastening elements are adapted to engage by pressing said fastening element perpendicular to the plane of said external surface of a vehicle.

Preferably said fastening elements are adapted to disengage by pulling said first fastening element perpendicular to the plane of said external surface of a vehicle.

Preferably said fastening elements comprise a substrate and a plurality of periodically spaced stems protruding perpendicularly from the substrate, each stem being symmetrical about the axis perpendicular to the substrate and having a first diameter at the distal end from the substrate greater than a second diameter at the end adjacent to said substrate.

A corresponding pair of first and second fastening elements may form a continuous strip.

In one embodiment, at least one gap is provided between two adjacent corresponding pairs of continuous first and second fastening elements. Preferably, the gap functions as a fluid outlet. More preferably, at least one fluid outlet is provided adjacent a downward facing edge of the panel.

Alternatively, or in addition, at least one fluid outlet is provided adjacent a rearward facing edge of the panel.

Preferably said first fastening element is adapted to reclosably interlock with a second fastening element such that on engagement there is an audible or tangible snap.

Preferably said first fastening element is attached to said flexible sheet by an attachment arrangement selected from a list of arrangements consisting of: bonding by adhesive, ultrasonic bonding, stitching and stapling.

Preferably said second fastening element is attached to said external surface of said vehicle by an attachment arrangement selected from a list of arrangements comprising: bonding by adhesive, ultrasonic bonding, stitching and stapling.

Optionally said display panel may be adapted to be further sealed substantially around the entire perimeter.

Preferably the display panel is further sealed by an adhesive tape.

Optionally the display panel is further sealed by a bead.

Optionally, a corner of the display panel may be further adapted to inhibit peeling of the corner.

Preferably the corner of the display panel is further adapted to inhibit peeling by a non-obtrusive adhesive patch.

BRIEF DESCRIPTION OF THE DRAWINGS

In order to provide a better understanding of the present invention, a preferred embodiment will now be described by way of example only and with reference to the accompanying Figures, in which.

DESCRIPTION OF THE ILLUSTRATIVE EMBODIMENTS

The invention relates to a panel, a vehicle, and a vehicle and panel assembly. In a further aspect the invention relates to a method that functions to attach the panel to the vehicle.

Figure 1:
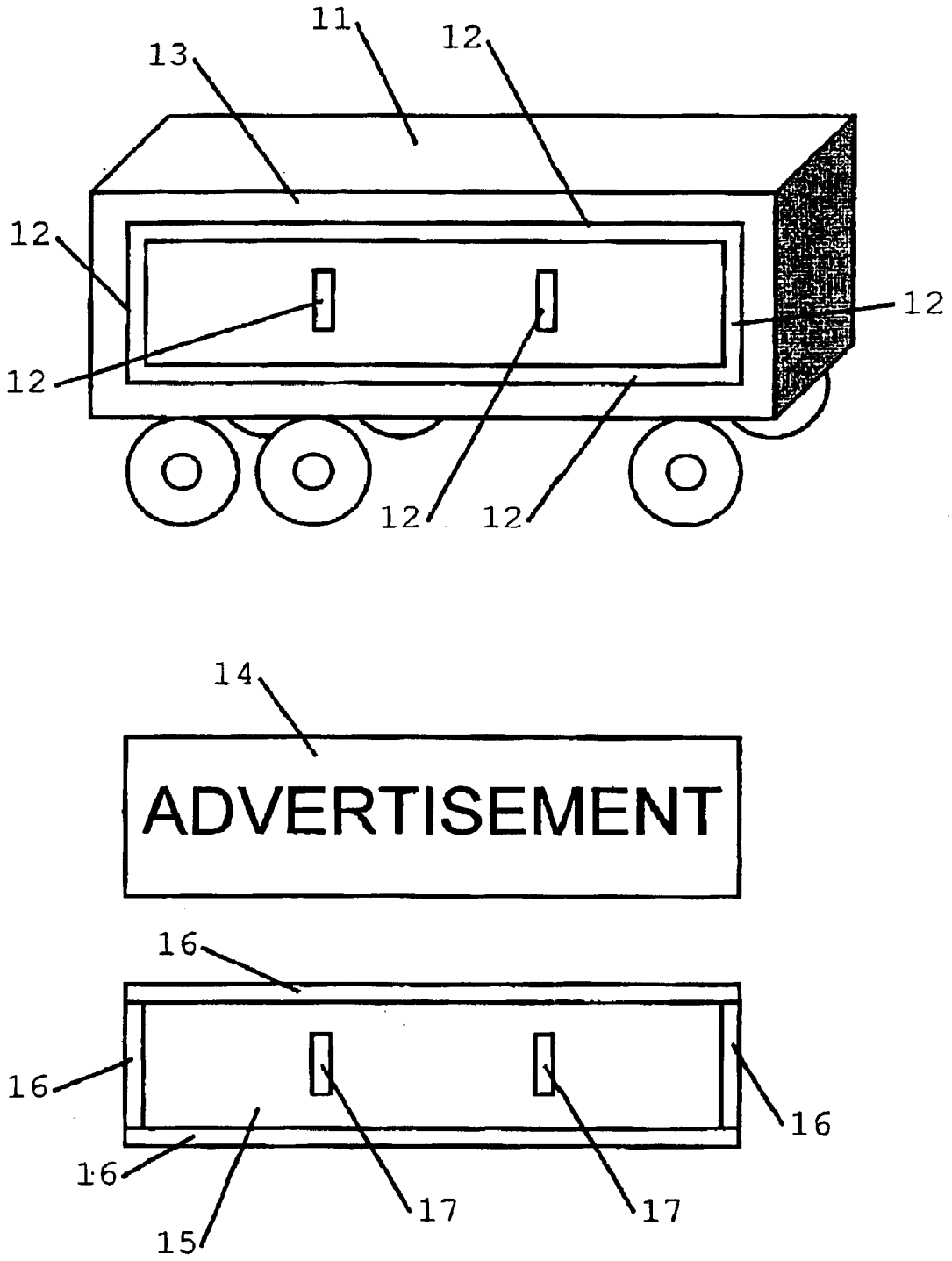
FIG. 1 illustrates in schematic form a truck trailer with fasteners attached and an advertising panel with corresponding fasteners attached in accordance with a preferred embodiment of the present invention.

With reference to FIG. 1, the printed side of a display panel such as an advertising panel 14 is shown. Typically the panel has a sheet of PES (polyethersulfone) fabric coated on both sides with PVC with a matt lacquer applied to the printing side. The lacquer allows the panel to be printed. The sheet is UV stabilised, anti-wicking and fire retardant. The sheet is substantially non-permeable in that it does not allow liquid or air to readily pass through it.

The size of the sheet may vary to fit the size of the side of a trailer. The typical weight is approximately 460 g/m$^2$.

The reverse of the sheet 15 has strips of a fastener 16 attached, for example by bonding with glue, ultrasonic bonding, stapling or stitching. The strips are attached around substantially the entire perimeter of the sheet, in that there are substantially no gaps left for air or fluid ingress after mounting on the truck or truck trailer. Optionally, one or more fasteners 17 may be placed away from the perimeter in order to provide support for the centre of the sheet.

In the preferred embodiment of the present invention, 3M™ Dual Lock™ reclosable fastener is used. In an alternative embodiment a hook and loop reclosable fastener such as 3M™ Scotchmate™ may be used, with the hook fastener on either the panel or the vehicle.

The truck trailer 11 has corresponding fasteners 12 arranged on its side 13, attached for example by bonding with glue, ultrasonic bonding, stapling or stitching. Although a truck trailer is illustrated in the preferred embodiment, the panel may be mounted on any external surface of a vehicle.

Figure 2A:
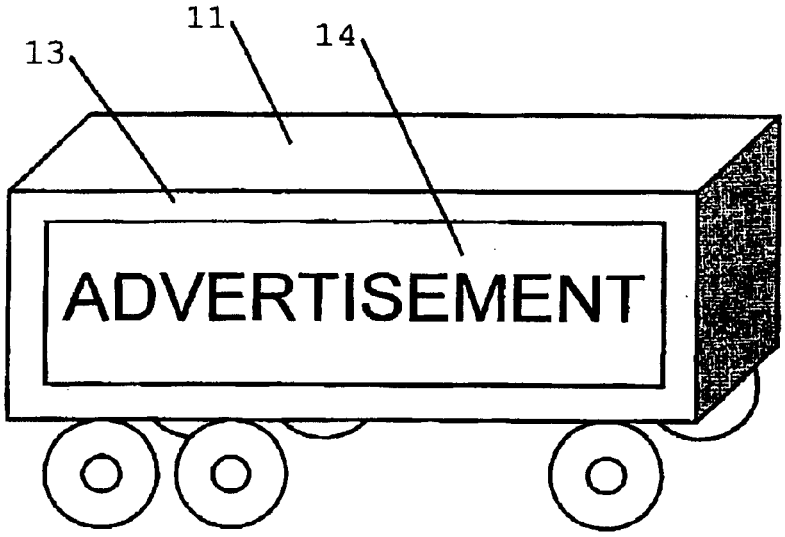
FIG. 2*a* illustrates a truck trailer with an advertising panel attached in accordance with a preferred embodiment of the present invention.

With reference to FIG. 2*a*, the advertising panel 14 is shown attached to the side 13 of the truck trailer 11, with the fasteners (that are shown in FIG. 1) on the panel 16 reclosably interlocked with the corresponding fasteners 12 on the side of the trailer.

Figure 2B:
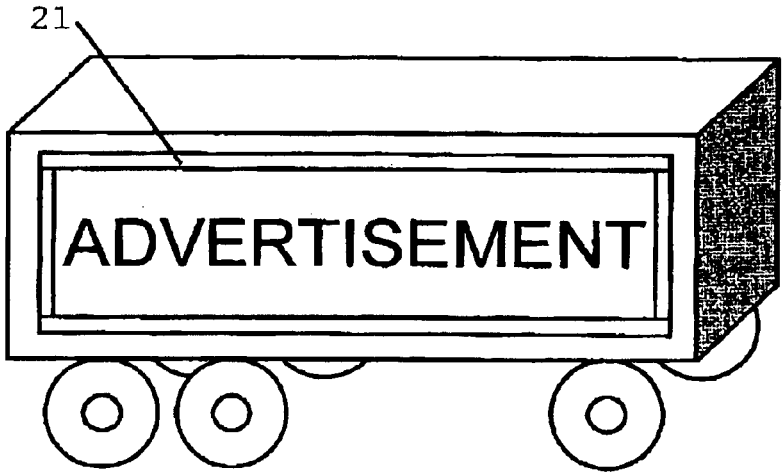
FIG. 2*b* illustrates a truck trailer with an advertising panel attached and sealed by tape in accordance with another embodiment of the present invention.

In a further embodiment, with reference to FIG. 2*b*, the seal may be enhanced by the application of an adhesive tape 21 around the perimeter of the panel bridging the panel and the surface of the vehicle. In yet a further embodiment, a bead for sealing by contacting the panel and vehicle surface may be attached to the fastener or the panel or the vehicle around the perimeter of the panel.

Figure 2C:
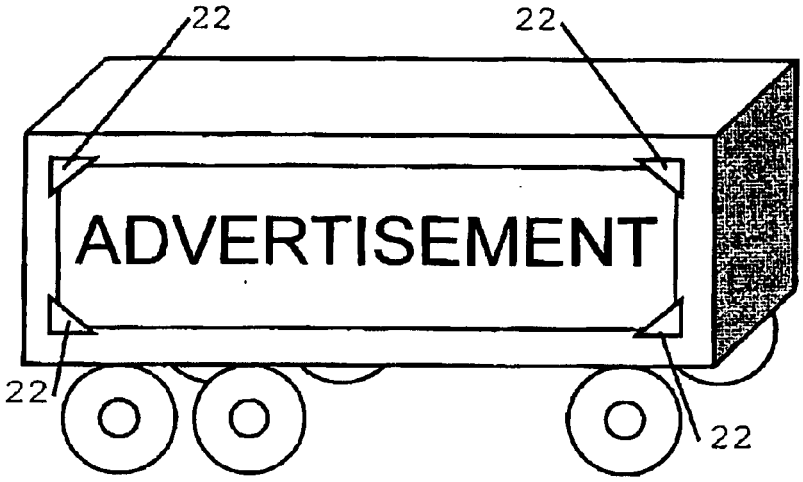
FIG. 2*c* illustrates a truck trailer with an advertising panel attached and with the corners protected from peeling in accordance with another embodiment of the present invention.

In a further embodiment, with reference to FIG. 2*c*, the corners of the panel may be protected from unwanted peeling by the application of an adhesive patch 22 at one or more corners of the panel bridging the panel and the surface of the vehicle. For certain applications, alternative more obtrusive methods of securing the patch might be used to supplement the attachment. These may include riveting and securing with a padlock.

Although this preferred embodiment applies to advertising panels, any sign may be printed on to the panel, including for example, identification numbers and images for emergency vehicles and removable number patches for racing cars.

Figure 3:
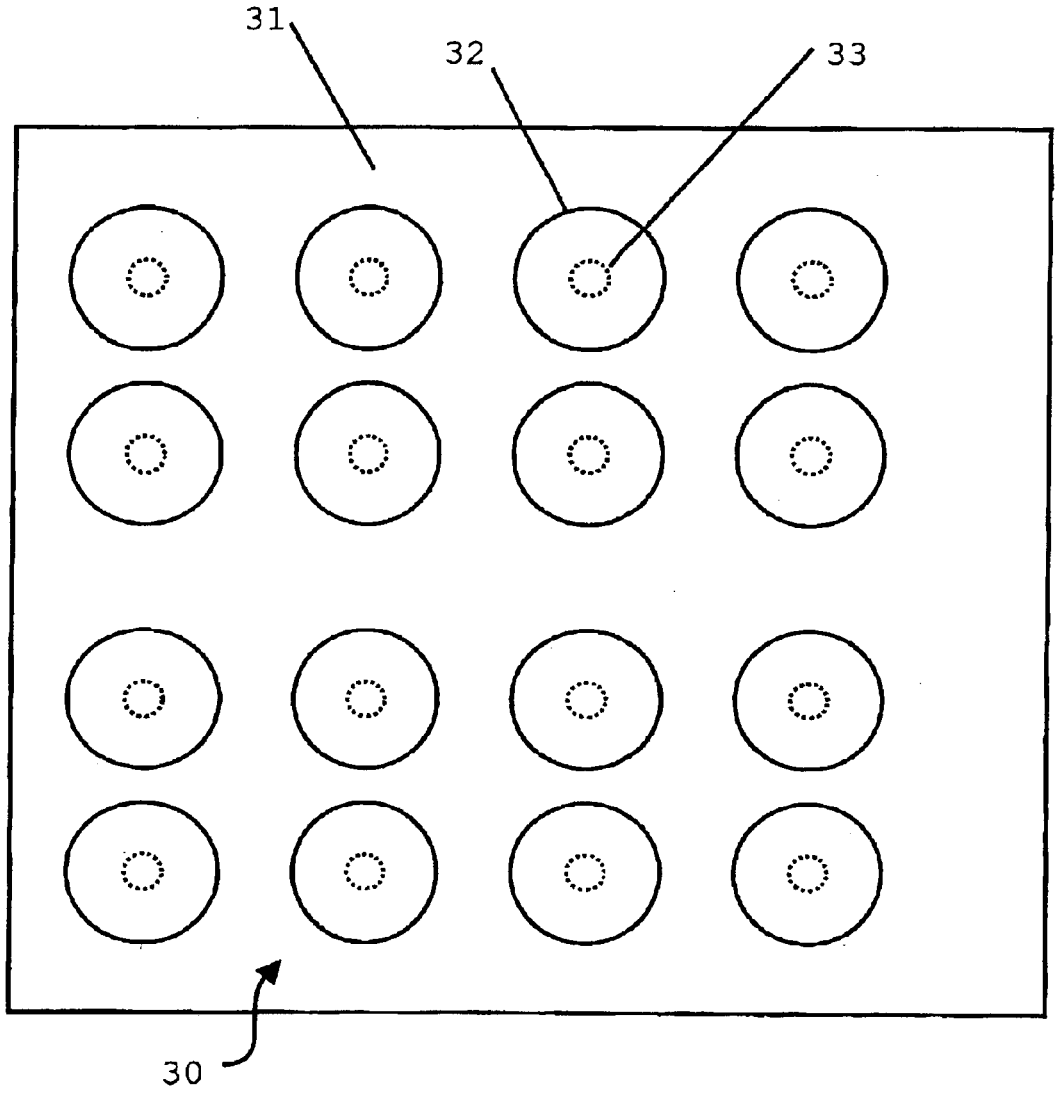
FIG. 3 illustrates in schematic form a plan view of a fastener in accordance with a preferred embodiment of the present invention.

FIG. 3 shows a plan view of a section of the fastener used on both the panel and the side of the trailer in accordance with this preferred embodiment. An array of stems 30 protrude from a substrate 31. Each stem is symmetrical about the axis perpendicular to the substrate, and has a first diameter at the distal end from the substrate 32 greater than a second diameter at the end adjacent to the substrate 33 (this is shown in FIG. 3 as a dotted line indicating that it would not be visible directly in this plan view).

Figure 4:
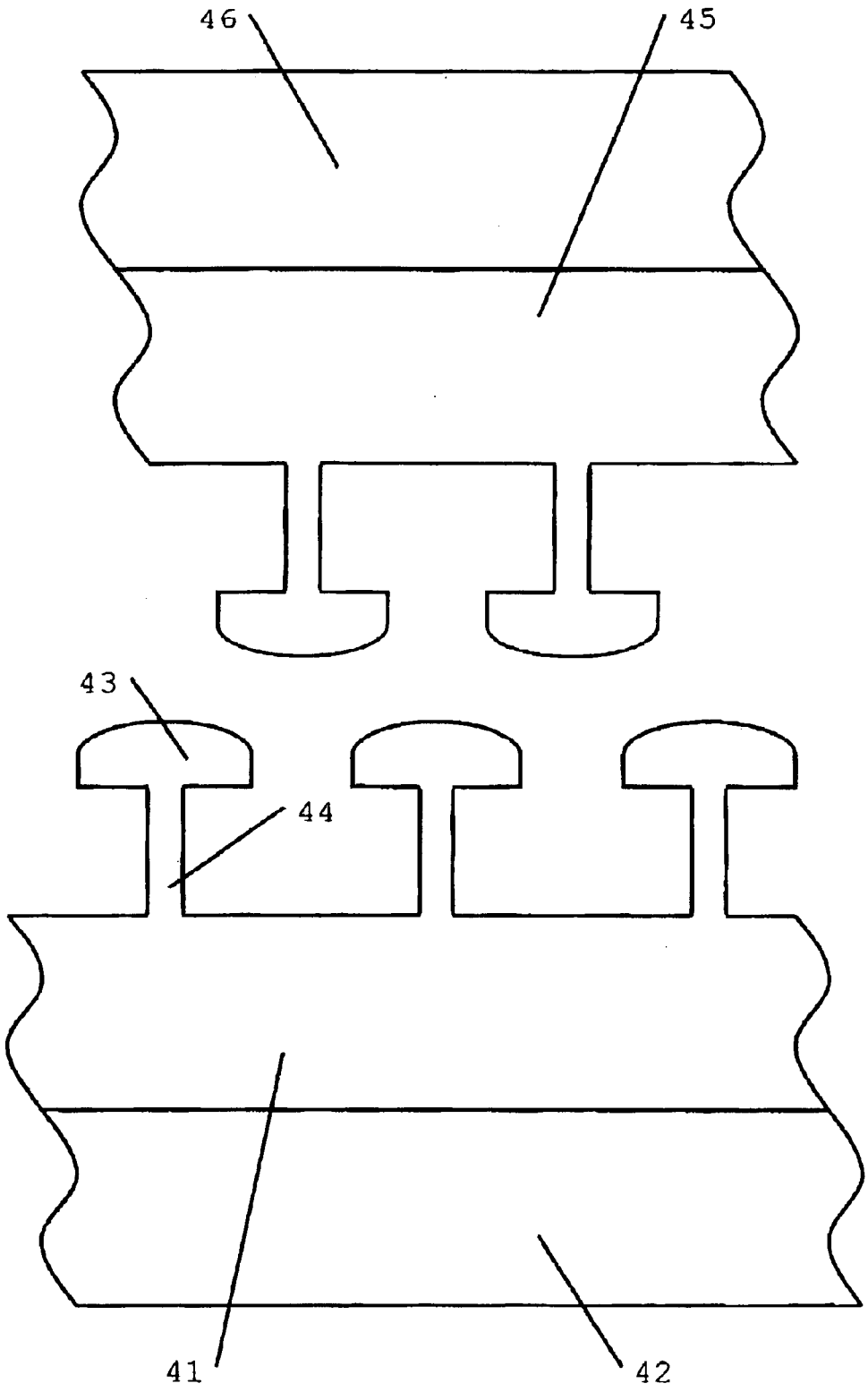
FIG. 4 illustrates in schematic form a section view of two disengaged fasteners in accordance with a preferred embodiment of the present invention.

With reference to FIG. 4, a cross-section of two pieces of fastener is shown according to the preferred embodiment of the present invention. The first piece 41 is attached by bonding to the advertising panel 42. In cross-section, the first diameter of the stem at the distal end from the substrate 43 can be seen to be greater than the second diameter 44 of the stem at the end adjacent to the substrate. A second fastener 45 is attached to the side of the truck trailer 46 by bonding.

Figure 5:
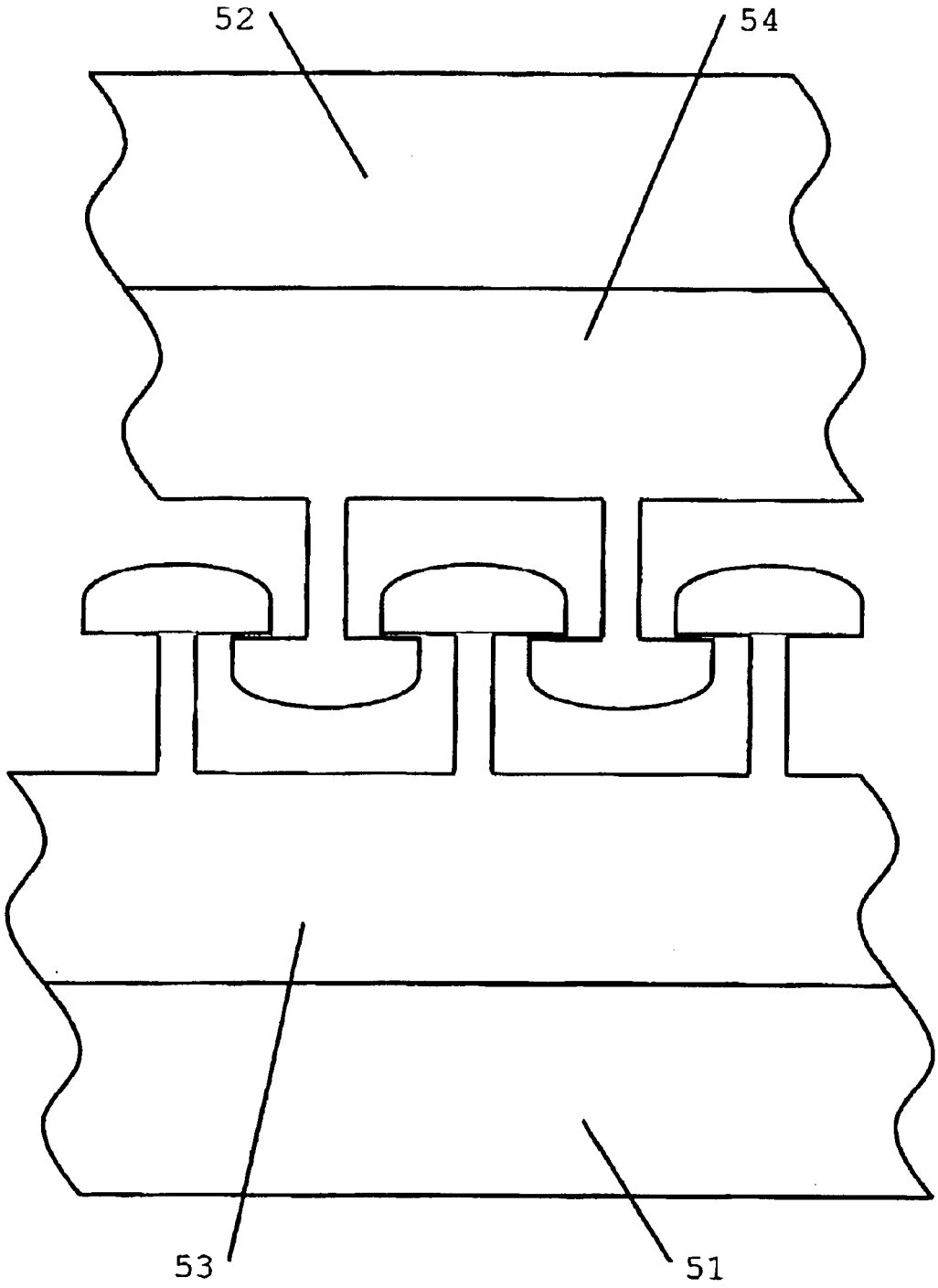
FIG. 5 illustrates in schematic form two engaged fasteners in accordance with a preferred embodiment of the present invention.

FIG. 5 shows the same fasteners as shown in FIG. 4, but after engagement by pressing together with the user pressing the panel 51 against the side of the truck trailer 52, thereby pushing the fastener attached to the panel 53 into interlocking engagement with the fastener 54 attached to the truck trailer.

In the preferred embodiment 3M™ Dual Lock™ reclosable fasteners are used on both the truck trailer and the advertising panel. The 3M™ Dual Lock™ fastener is constructed of polypropylene and has an acrylic adhesive and a liner applied to the opposite side of the substrate to the protruding stems.

This type of fastener has several advantages. The fastener is low profile and is not obtrusive from the side of the truck trailer or the advertising panel. It is flexible, allowing attachment to flexible curtains on the side of a truck trailer and allowing the advertising panel to be rolled up after having the fastener attached. Two fasteners will reclosably interlock when one is oriented within the full 360° in the plane of the substrates with respect to another fastener. When engaged, disengagement by sheer force is equal in perpendicular directions to the plane of the attached substrates. The fasteners will reclosably interlock with an audible snap to indicate to the worker that the advertising panel is successfully attached to the truck trailer.

When installing an advertising panel, the worker can apply the same fastener to both the panel and the side of the truck trailer without, for example, a male and a female fastener being needed and a convention being needed to decide which type of fastener to apply to the advertising panel. The flexible nature of the fastener allows it to wrap around the contour of non-planar vehicle surfaces. Engaging the fasteners can be achieved simply by pressing perpendicularly to the plane of the surface of the vehicle and the fasteners may be disengaged simply by pulling the advertising panel perpendicular to the plane of the surface of the vehicle. The intimate nature and low profile of the reclosable interlocking fasteners presents a low area at its edge that is resistant to the ingress of liquids when the panel is being cleaned, and air when the truck is being driven, thereby preventing flapping and billowing of the panel during vehicle motion.

Figure 6:
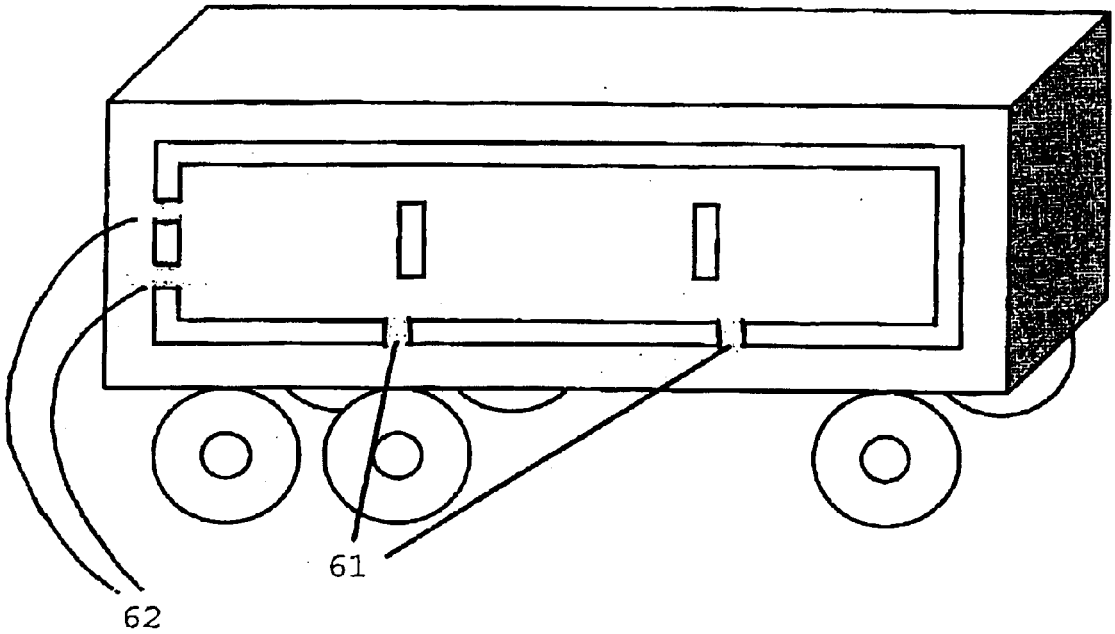
FIG. 6 illustrates in schematic form a truck trailer with fasteners attached and an advertising panel with corresponding fasteners attached in accordance with an alternative embodiment of the present invention.
Figure 6:
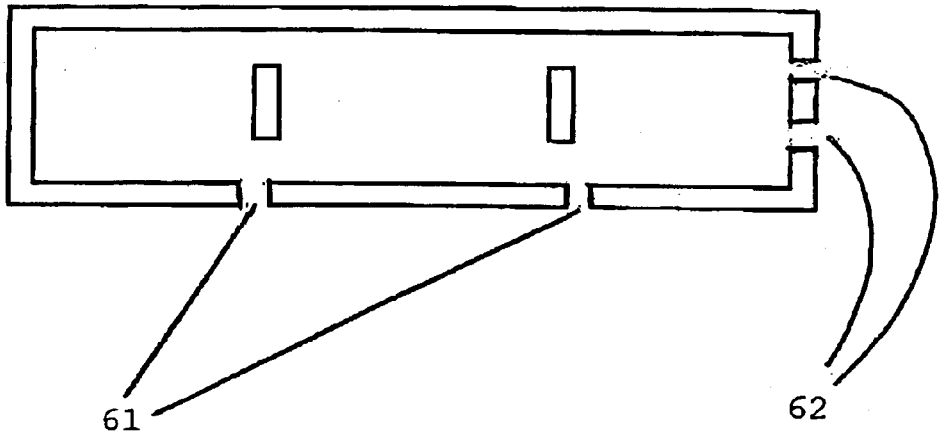

In general, it is desirable to have a continuous strip of fastening material around the entire perimeter of the panel and vehicle surface. This will resist ingress of water and air, and help maintain a secure fastening. However, it some circumstances it may be desirable to provide functional breaks in the fastening material FIG. 6 shows an alternative embodiment of the invention being provided with a number of strategically placed outlets 61, 62. These outlets are in fact breaks formed in the fastener strips 12 provided on the vehicle. Breaks are also provided at corresponding locations of the strips 16 on the panel.

The outlets 61 are provided in the fastening material adjacent the downward facing edge of the vehicle and panel. These outlets are spaced approximately one third and two thirds along the total length of the fastener material, and are, for example, approximately 100 mm long. The outlets 61 allow drainage of any liquid, such as rainwater, that has entered the region between the vehicle surface and the inner surface of the panel.

The outlets 62 are provided in the fasteners adjacent the rearward facing edge of the vehicle and panel. The outlets 62 are spaced approximately one third and two thirds along the total height of the fastener material, and are, for example, approximately 25 mm long. These outlets function as exhaust ports for any air that as entered the region between the vehicle surface and the inner surface of the panel through the fastening material or elsewhere.

Air build-up between the panel and the vehicle has a tendency to raise the panel from the vehicle surface, which may result in billowing or flapping. Water build-up potentially causes similar problems around the lower edge of the panel. Ultimately, this can cause damage to the panel or vehicle, and loosening of the fastening strips. In addition, the image applied to the panel could be distorted. Furthermore, the presence of water between the panel and the vehicle may cause difficulties when removing the panel, due to surface tension effects.

Although the fastening material used with the invention is likely to mitigate air and water ingress, it may still occur in certain conditions. The outlets 61, 62 prevent undesirable trapping of liquid and air between the panel and the vehicle surface, should any liquid or air penetrate the fastening material.

It will be evident that the outlets could be located in alternative positions, or could constitute more than a simple break in the fastener. For example, the outlet may be a moulded plastic channel.

Further modifications and improvements may be added without departing from the scope of the invention herein intended.

What is claimed:

1. A method of mounting a display panel comprising a substantially non-permeable flexible sheet to a vehicle, the method comprising the steps of:

attaching at least one first fastening element to said flexible sheet around the majority of the perimeter of said flexible sheet;

attaching at least one second fastening element to an external surface of the vehicle, the external surface of the vehicle being oriented substantially in a surface plane; and imparting a force to said first and second fastening elements in a direction substantially perpendicular to the surface plane; and further sealing the display panel substantially around the entire perimeter of the panel by applying an adhesive tape.

2. The method as claimed in claim 1 wherein said fastening elements are adapted to disengage by pulling said first fastening element perpendicular to the plane of said external surface of a vehicle.

3. The method as claimed in claim 1 wherein said first fastening element is attached to said flexible sheet by an attachment arrangement selected from a list of arrangements consisting of: bonding by adhesive, ultrasonic bonding, stitching and stapling.

4. The method as claimed in claim 1 wherein said second fastening element is attached to said external surface of said vehicle by an attachment arrangement selected from a list of arrangements comprising: bonding by adhesive, ultrasonic bonding, stitching and stapling.

5. A method of mounting a display panel comprising a substantially non-permeable flexible sheet to a vehicle, the method comprising the steps of:

attaching at least one first fastening element to said flexible sheet around the majority of the perimeter of said flexible sheet;

attaching at least one second fastening element to an external surface of the vehicle, the external surface of the vehicle being oriented substantially in a surface plane; and imparting a force to said first and second fastening elements in a direction substantially perpendicular to the surface plane; and further sealing the display panel substantially around the entire perimeter of the panel by applying a bead.

6. A method of mounting a display panel comprising a substantially non-permeable flexible sheet to a vehicle, the method comprising the steps of:

attaching at least one first fastening element to said flexible sheet around the majority of the perimeter of said flexible sheet;

attaching at least one second fastening element to an external surface of the vehicle; the external surface of the vehicle being oriented substantially in a surface plane; and imparting a force to said first and second fastening elements in a direction substantially perpendicular to the surface plane; and inhibiting a corner of the panel from peeling away from the surface of the vehicle by applying an adhesive patch.

* * * * *